US009512744B2

(12) United States Patent
Braun

(10) Patent No.: US 9,512,744 B2
(45) Date of Patent: Dec. 6, 2016

(54) ROCKER ARM CLIP RETENTION FEATURE

(71) Applicant: Schaeffler Technologies AG & Co. KG, Herzogenaurach (DE)

(72) Inventor: Gail Braun, Bloomfield Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/673,107

(22) Filed: Mar. 30, 2015

(65) Prior Publication Data

US 2015/0308300 A1 Oct. 29, 2015

Related U.S. Application Data

(60) Provisional application No. 61/985,198, filed on Apr. 28, 2014.

(51) Int. Cl.
*F01L 1/18* (2006.01)
*F01L 1/255* (2006.01)

(52) U.S. Cl.
CPC ..... *F01L 1/18* (2013.01); *F01L 1/255* (2013.01); *F01L 2001/187* (2013.01)

(58) Field of Classification Search
CPC ..... F01L 1/18; F01L 1/255; F01L 2001/187
USPC ..... 123/90.44
See application file for complete search history.

(56) References Cited

U.S. PATENT DOCUMENTS

| | | | | |
|---|---|---|---|---|
| 4,598,674 | A * | 7/1986 | Nono | F01L 1/185 123/90.41 |
| 4,784,095 | A * | 11/1988 | Golding | F01L 1/183 123/90.33 |
| 5,819,694 | A * | 10/1998 | Trutescu | F01L 1/185 123/90.39 |
| 8,561,586 | B2 * | 10/2013 | Kishi | F01L 1/185 123/90.43 |
| 2007/0221154 | A1 * | 9/2007 | Smith | F01L 1/185 123/90.44 |
| 2011/0011361 | A1 * | 1/2011 | Roberts | F01L 1/185 123/90.55 |
| 2011/0017160 | A1 | 1/2011 | Kishi et al. | |

* cited by examiner

*Primary Examiner* — Zelalem Eshete
(74) *Attorney, Agent, or Firm* — Volpe and Koenig, P.C.

(57) ABSTRACT

A rocker arm assembly including a rocker arm with an end portion including a socket portion on a top surface and a groove formed on the socket portion is provided. A clip having a generally C-shaped cross-section is provided. The clip includes a first leg with an opening that defines an inner edge that at least partially engages the groove on the socket portion of the rocker arm. The clip includes an intermediate leg including an opening through which a protrusion on the axial end of the rocker arm extends. The clip includes a second leg including first and second leg portions that engage the bottom surface of the rocker arm.

11 Claims, 6 Drawing Sheets

ROCKER ARM CLIP RETENTION FEATURE

INCORPORATION BY REFERENCE

The following documents are incorporated herein by reference as if fully set forth: U.S. Provisional Patent Application No. 61/985,198, filed Apr. 28, 2014.

FIELD OF INVENTION

This application is generally related to a rocker arm or finger lever arrangement and is more particularly related to a retention clip for a rocker arm arrangement.

BACKGROUND

Rocker arms are used in automotive applications in connection with camshafts. Rocker arms or finger levers may include a middle section for a cam contact surface and two end portions. A first end portion includes an abutment portion for a valve stem, and a second end portion is adapted for engaging a hydraulic lash adjuster. The hydraulic lash adjuster includes a plunger that is axially displaceable within a housing. The plunger engages with a dome-shaped recess formed on a bottom surface of the second end portion of the rocker arm. Known rock arm arrangements, such as the arrangement shown in U.S. Patent Publication No. 2011/0017160, provide configurations including clips for preventing the plunger of the hydraulic lash adjuster from falling out of engagement with the dome-shaped recess of the rocker arm. These known arrangements do not guarantee retention of the clip with the rocker arm, allowing the clip to fall off during shipping or processing prior to assembly, and in some cases, even during use. It would be desirable to provide a clip that includes features for retaining the clip with both the hydraulic lash adjuster and the rocker arm.

SUMMARY

A rocker arm assembly including a retention clip and a rocker arm with a groove for retaining the clip is provided. The rocker arm assembly includes a rocker arm including a first end portion with an abutment portion for a valve stem. The rocker arm includes a medial portion for a cam contact surface. A second end portion of the rocker arm includes a socket portion on a top surface. A groove is formed on the socket portion, and a dome-shaped recess is formed on a bottom surface of the second end portion. A protrusion extends on an axial end of the second end portion. A clip having a generally C-shaped cross-section is provided. The clip includes a first leg with an opening that defines an inner edge that at least partially engages the groove on the socket portion of the rocker arm. The clip includes an intermediate leg including an opening through which the protrusion on the axial end of the rocker arm extends. The clip includes a second leg including first and second leg portions that engage the bottom surface of the rocker arm.

In another aspect, a rocker arm arrangement is provided including the rocker arm assembly as noted above and a hydraulic lash adjuster including a housing and a plunger axially displaceable therein. The plunger includes a dome-shaped axial end portion that engages with the dome-shaped recess on the bottom surface of the rocker arm. A tapered portion is located adjacent to the dome-shaped axial end portion. The first and second leg portions of the second leg of the clip are located beneath the dome-shaped axial end portion in a region of the tapered portion of the plunger.

Preferred arrangements with one or more features of the invention are described below and in the claims.

BRIEF DESCRIPTION OF THE DRAWINGS

The foregoing Summary as well as the following Detailed Description will be best understood when read in conjunction with the appended drawings. In the Drawings.

DETAILED DESCRIPTION OF THE PREFERRED EMBODIMENTS

Figure 1:
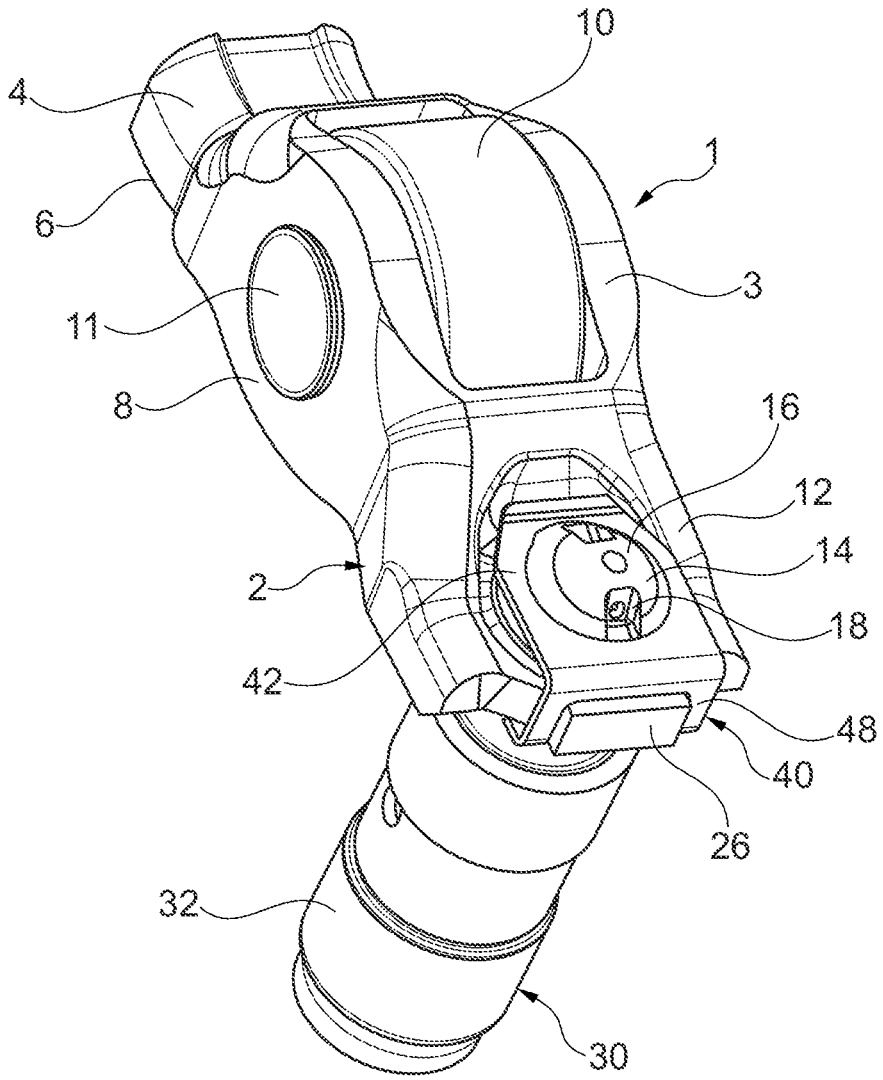
FIG. 1 is a perspective view of a rocker arm arrangement with a rocker arm assembly according to the present invention.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivates thereof, and words of similar import.

Figure 2:
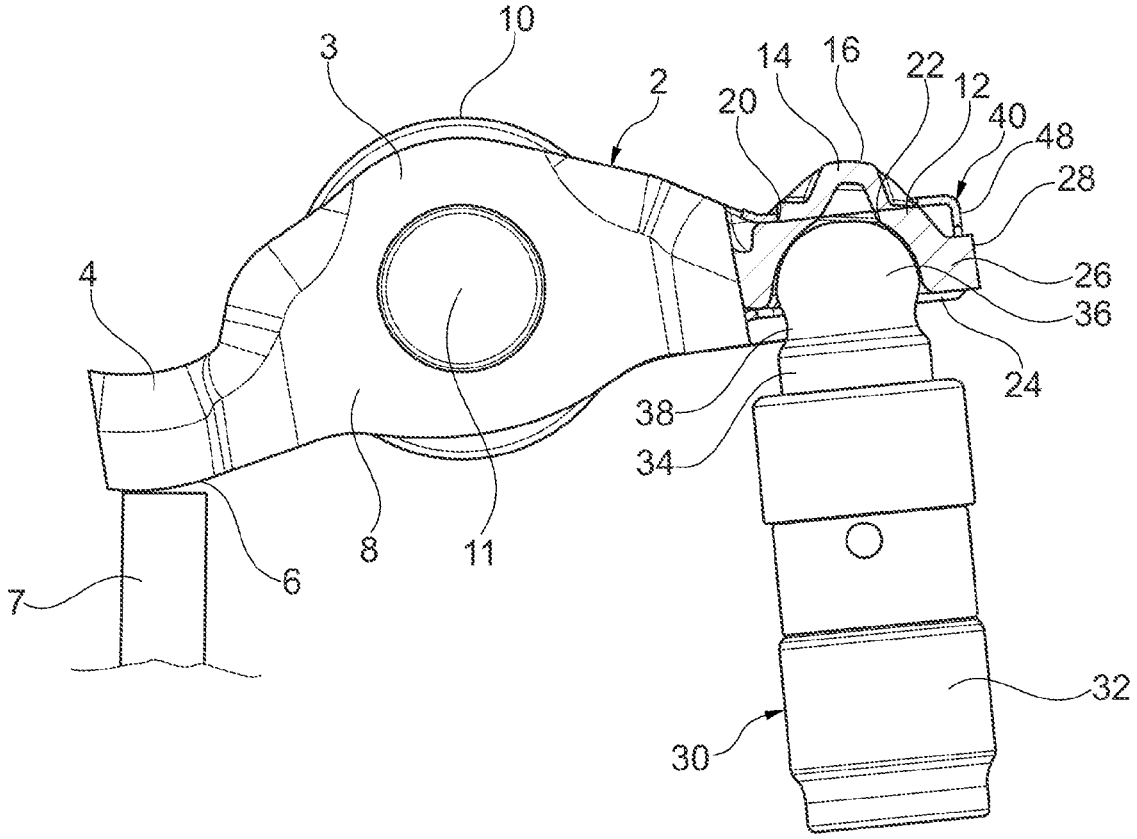
FIG. 2 is a side partial cross-sectional view of the rocker arm arrangement of FIG. 1.
Figure 4:
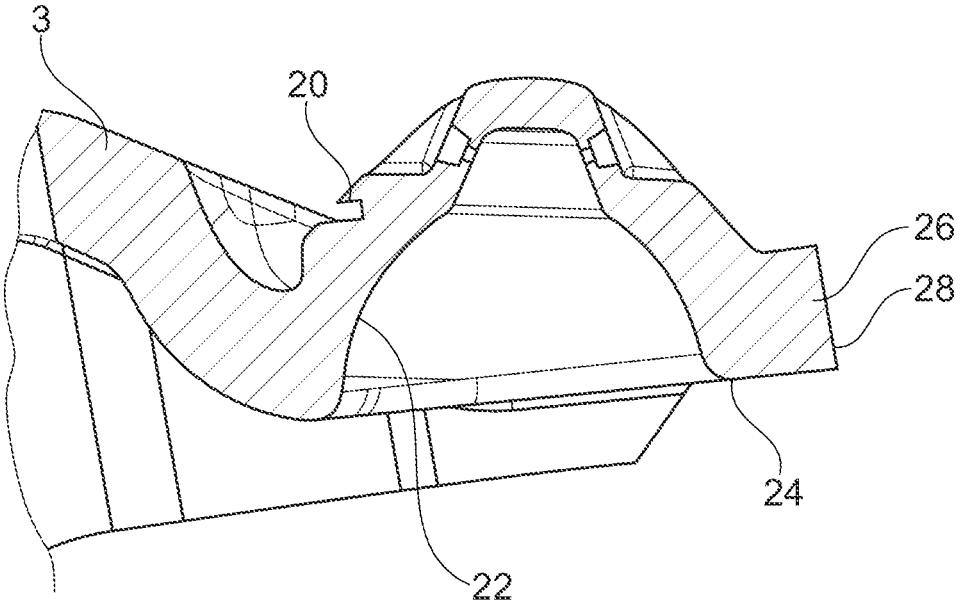
FIG. 4 is a cross-sectional view of the socket portion of the rocker arm of FIG. 3 without the clip.
Figure 8:
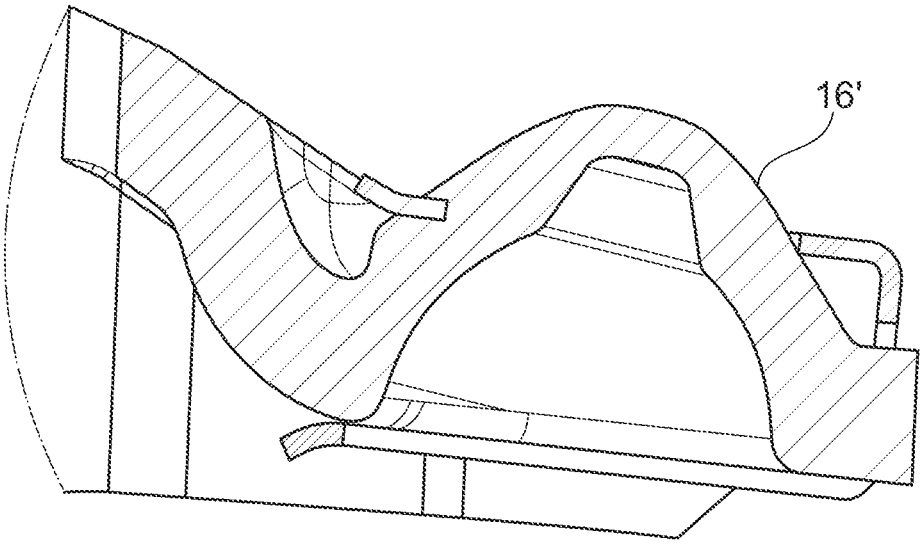
FIG. 8 is a cross-sectional view through the socket portion of another embodiment of the rocker arm assembly.

FIGS. 1 and 2 show a rocker arm arrangement 1 including a rocker arm assembly 2, a retention clip 40, and a groove 20 for retaining the clip 40, as well as a lash adjuster 30. The rocker arm assembly 2 includes a rocker arm 3 including a first end portion 4 with an abutment portion 6 for a valve stem head 7. The rocker arm 3 includes a medial portion 8 for a cam contact surface 10. A second end portion 12 of the rocker arm 3 includes a socket portion 14 on a top surface 16 having at least one oil spray hole 18. As shown more clearly in FIG. 4, a groove 20 is formed on the socket portion 14, and a dome-shaped recess 22 is formed on a bottom surface 24 of the second end portion 12. In a preferred arrangement, the groove 20 is formed below the at least one oil spray hole 18 on the socket portion 14. In another configuration shown in FIG. 8, the top surface 16 does not include an oil spray hole 18. A protrusion 26 extends on an axial end 28 of the second end portion 12. In another preferred rocker arm assembly 2, the cam contact surface 10 is a roller that is assembled to the rocker arm 3 via a pin 11. The clip 40 is also assembled onto the second end portion 12.

The rocker arm arrangement 1 includes the rocker arm assembly 2 and the hydraulic lash adjuster 30 with a housing 32 and a plunger 34 axially displaceable therein. The plunger 34 includes a dome-shaped axial end portion 36 that engages with the dome-shaped recess 22 on the bottom surface 24 of the rocker arm 3. A tapered portion 38 is located adjacent to the dome-shaped axial end portion 36.

Figure 3:
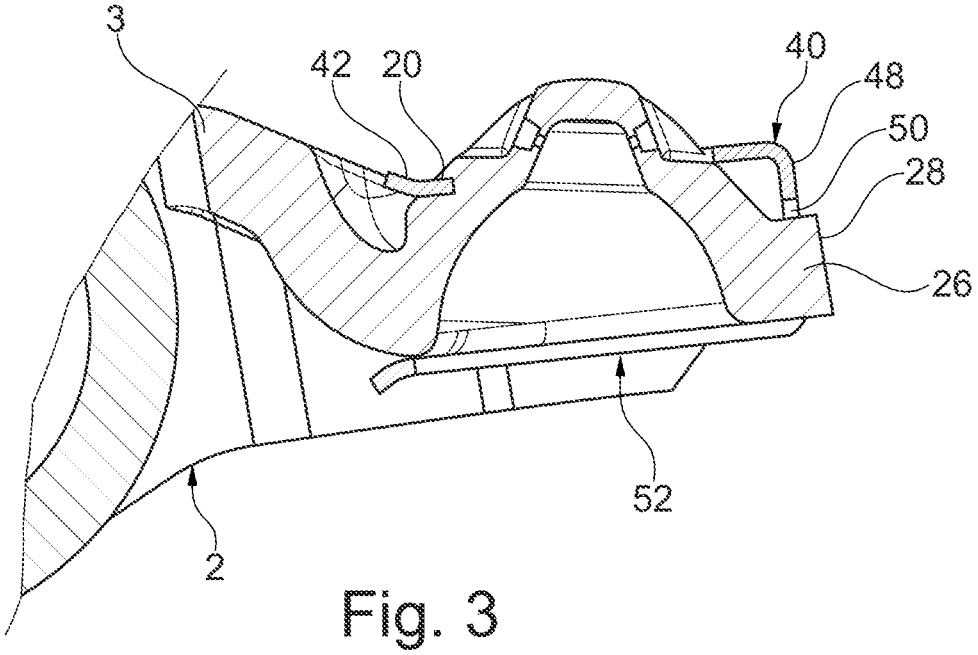
FIG. 3 is a cross-sectional view of a socket portion of the rocker arm assembly of FIGS. 1 and 2 with a clip engaged with the socket portion.
Figure 5:
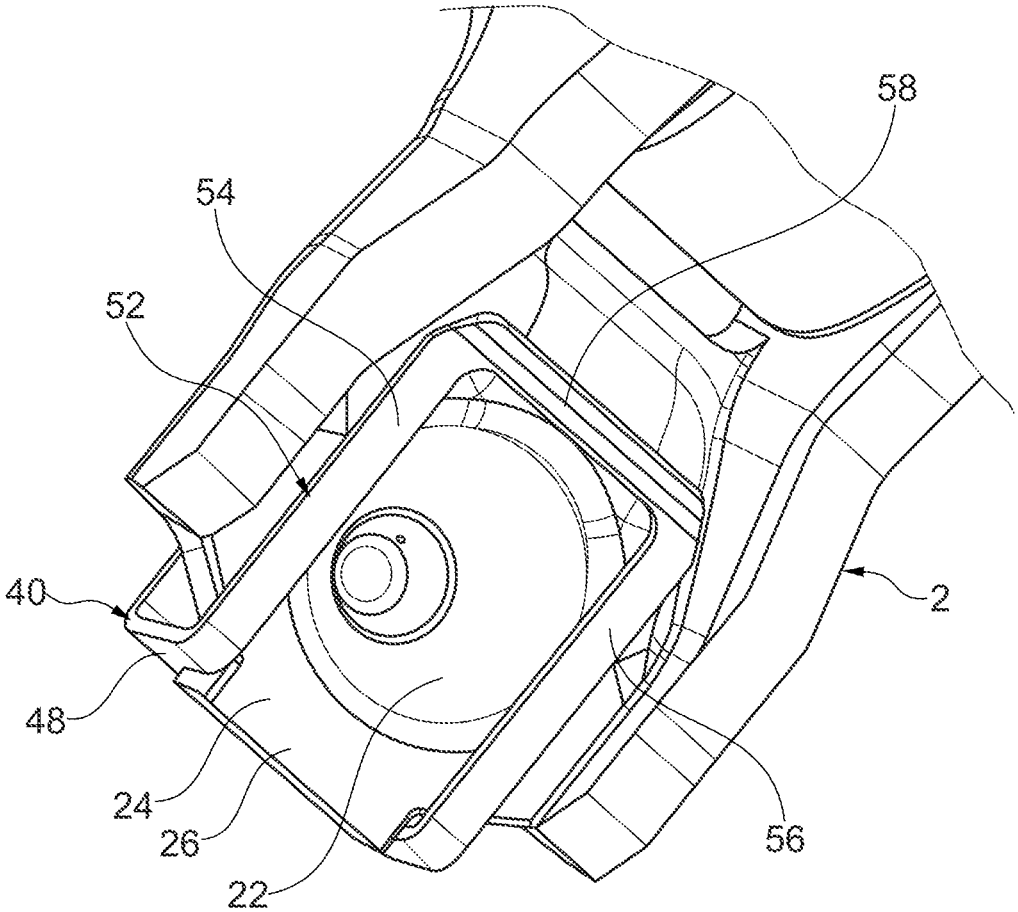
FIG. 5 is a bottom perspective view of an end of the rocker arm assembly of FIGS. 1-4 with the clip engaged on a bottom surface of the rocker arm.
Figure 6:
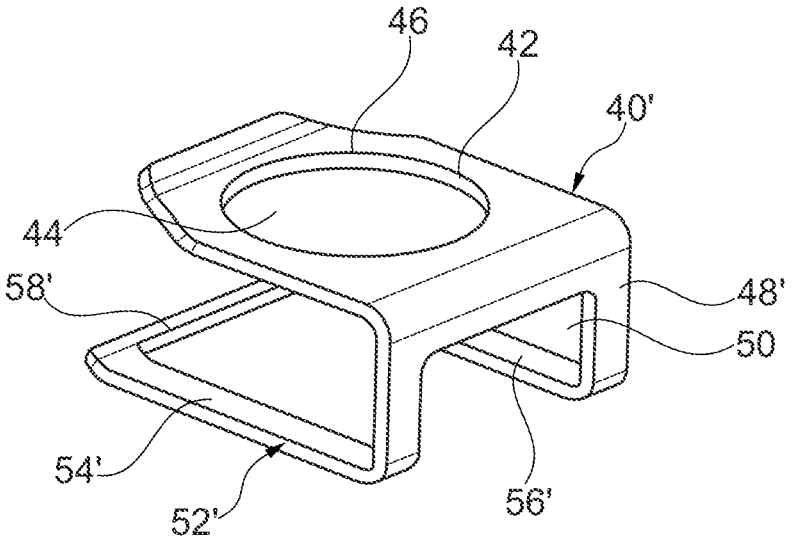
FIG. 6 is a perspective view of a first embodiment of a clip according to the invention.
Figure 7:
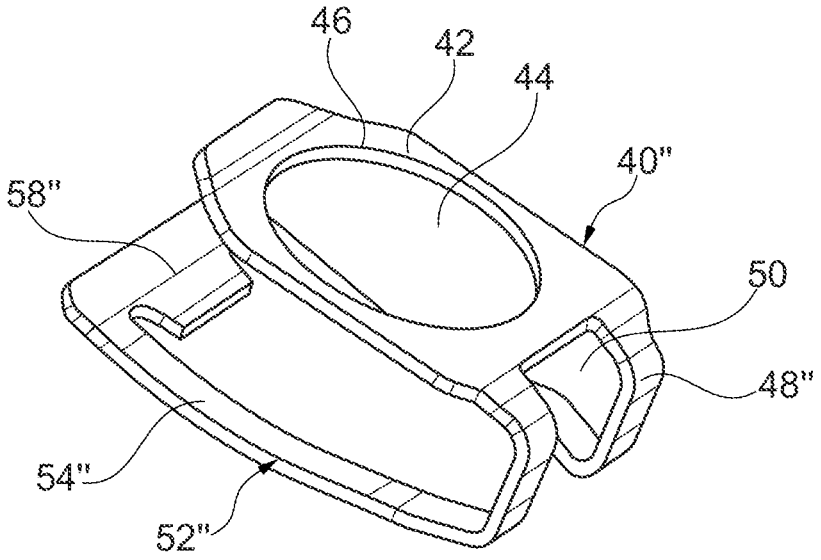
FIG. 7 is a perspective view of a second embodiment of a clip according to the invention.

As shown more clearly in FIG. 3, the clip 40 engages the groove 20 formed on the rocker arm 3. In a preferred arrangement, the clip 40 is formed from steel spring. The clip 40 has a generally C-shaped cross-section. The clip 40 includes a first leg 42 with an opening 44 that defines an inner edge 46 that at least partially engages the groove 20 on the socket portion 14 of the rocker arm 3. The clip 40 includes an intermediate leg 48 including an opening 50 through which the protrusion 26 on the axial end 28 of the rocker arm 3 extends. As shown in FIG. 5, the clip 40 further includes a second leg 52 including a first leg portion 54 and a second leg portion 56 that both engage the bottom surface 24 of the rocker arm 3 and are adapted to be located beneath the dome-shaped axial end portion 36 in a region of the tapered portion 38 of the plunger 34. As shown in FIG. 5, the first and second leg portions 54, 56 are connected by a bar 58. In a preferred arrangement, the first leg portion 54 and the second leg portion 56 engage opposite sides of the tapered portion 38 of the plunger 34. In a first preferred embodiment of the clip 40' shown in FIG. 6, the second leg 52' includes first and second leg portions 54', 56' that extend in a straight line and are connected together at the free ends via a bar 58'. In a second preferred embodiment of the clip 40" shown in FIG. 7, the second leg 52" includes first and second leg portions 54", 56" that have a curvature and are connected together at the free ends via a bar 58". In this embodiment, the intermediate leg 48" also has a curvature at its ends. One of ordinary skill in the art recognizes any leg configuration capable of retaining the clip 40 with the plunger 34 is possible.

According to the invention, the rocker arm assembly 2 can be preassembled with clips 40, 40', 40" without fear of the clip 40, 40', 40" becoming dislodged during handling or further assembly due to the clip 40, 40', 40" engaging in the groove 20 as well as over the protrusion 26. Once the clip 40, 40', 40" is snapped over the dome-shaped end portion 36 of the plunger 34 of a hydraulic lash adjuster 30, it is positively retained and cannot be dislodged due to the clip 40, 40', 40" configuration.

Having thus described various embodiments of the present rocker arm arrangement in detail, it is to be appreciated and will be apparent to those skilled in the art that many physical changes, only a few of which are exemplified in the detailed description above, could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

LIST OF REFERENCE NUMBERS

1 Rocker Arm Arrangement
2 Rocker Arm Assembly
3 Rocker Arm
4 First End Portion of Rocker Arm
6 Abutment Portion
8 Medial Portion
10 Cam Contact Surface
11 Pin
12 Second End Portion of Rocker Arm
14 Socket Portion
16 Top Surface of Rocker Arm
18 Oil Spray Hole
20 Groove on Socket Portion
22 Dome-Shaped Recess
24 Bottom Surface of Rocker Arm
26 Protrusion
28 Axial End of Second End Portion of Rocker Arm
30 Hydraulic Lash Adjuster
32 Housing
34 Plunger
36 Dome-Shaped Axial End Portion of Plunger
38 Tapered Portion of Plunger
40, 40', 40" Clip
42 First Leg of Clip
44 Opening of First Leg of Clip
46 Inner Edge of Opening On Clip
48, 48', 48" Intermediate Leg
50 Opening on Intermediate Leg
52, 52', 52" Second Leg of Clip
54, 54', 54" First Leg Portion of Second Leg of Clip
56, 56', 56" Second Leg Portion of Second Leg of Clip
58, 58', 58" Bar

What is claimed is:

1. A rocker arm assembly comprising:

a rocker arm including a first end portion with an abutment portion for a valve stem, a medial portion for a cam contact surface, and a second end portion including a socket portion on a top surface, a groove formed on the socket portion, a dome-shaped recess formed on a bottom surface of the second end portion, and a protrusion on an axial end of the second end portion; and a clip having a generally C-shaped cross-section, including a first leg with an opening that defines an inner edge that at least partially engages the groove on the socket portion of the rocker arm, an intermediate leg including an opening through which the protrusion on the axial end of the rocker arm extends, and a second leg including first and second leg portions that engage the bottom surface of the rocker arm.

2. The rocker arm assembly of claim 1, wherein the top surface of the socket portion includes at least one oil spray hole.

3. The rocker arm assembly of claim 2, wherein the groove is formed below the at least one oil spray hole on the socket portion.

4. The rocker arm assembly of claim 1, wherein the first and second leg portions extend in a straight line.

5. The rocker arm assembly of claim 1, wherein the first and second leg portions have a curvature.

6. The rocker arm assembly of claim 1, wherein the clip is formed from spring steel.

7. The rocker arm assembly of claim 1, wherein a bar connects free ends of the first and second leg portions.

8. The rocker arm assembly of claim 1, wherein the groove extends into the socket portion and the groove extends in a direction parallel to the first leg of the clip.

9. A rocker arm arrangement comprising:

a rocker arm including a first end portion with an abutment portion for a valve stem, a medial portion for a cam contact surface, and a second end portion including a socket portion on a top surface, a groove formed on the socket portion, a dome-shaped recess formed on a bottom surface of the second end portion, and a protrusion on an axial end of the second end portion;

a hydraulic lash adjuster including a housing and a plunger axially displaceable therein, the plunger includes a dome-shaped axial end portion that engages with the dome-shaped recess on the bottom surface of the rocker arm, and a tapered portion located adjacent to the dome-shaped axial end portion; and a clip having a generally C-shaped cross-section, including a first leg with an opening that defines an inner edge that at least partially engages the groove on the socket portion of the rocker arm, an intermediate leg including an opening through which the protrusion on the axial end of the rocker arm extends, and a second leg including first and second leg portions that engage the bottom surface of the rocker arm and are adapted to be located beneath the dome-shaped axial end portion in a region of the tapered portion of the plunger.

10. The rocker arm arrangement of claim 9, wherein the first and second leg portions are elastically deformable to form a snap fit engagement over the dome-shaped axial end portion of the plunger.

11. The rocker arm arrangement of claim 9, wherein the first and second leg portions engage opposite sides of the tapered portion of the plunger.

* * * * *